US010894410B2

(12) United States Patent
Asai

(10) Patent No.: US 10,894,410 B2
(45) Date of Patent: Jan. 19, 2021

(54) METHOD OF MANUFACTURING LIQUID EJECTION HEAD AND METHOD OF FORMING RESIST

(71) Applicant: CANON KABUSHIKI KAISHA, Tokyo (JP)

(72) Inventor: Kazuhiro Asai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/599,420

(22) Filed: Oct. 11, 2019

(65) Prior Publication Data

US 2020/0139711 A1 May 7, 2020

(30) Foreign Application Priority Data

Nov. 2, 2018 (JP) ..... 2018-207236

(51) Int. Cl.
*B41J 2/16* (2006.01)

(52) U.S. Cl.
CPC ..... *B41J 2/1623* (2013.01); *B41J 2/1629* (2013.01); *B41J 2/1631* (2013.01); *B41J 2202/22* (2013.01)

(58) Field of Classification Search
CPC ..... B41J 2/1623; B41J 2/1629; B41J 2/1631; B41J 2202/22; B41J 2/1639; B41J 2/1628; B41J 2/1632; B41J 2/1634; B41J 2/1645; B41J 2/1603
USPC ..... 216/27
See application file for complete search history.

(56) References Cited

U.S. PATENT DOCUMENTS

| | | | | |
|---|---|---|---|---|
| 7,963,634 | B2 * | 6/2011 | Yokouchi | B41J 2/1604 347/54 |
| 9,457,559 | B2 * | 10/2016 | Higuchi | B41J 2/1631 |
| 9,873,255 | B2 * | 1/2018 | Sasaki | B41J 2/162 |
| 9,919,526 | B2 | 3/2018 | Asai et al. | |
| 10,421,276 | B2 * | 9/2019 | Saito | B41J 2/1404 |
| 2018/0154637 | A1 | 6/2018 | Asai et al. | |

FOREIGN PATENT DOCUMENTS

JP 2015-104876 A 6/2015

* cited by examiner

*Primary Examiner* — Duy Vu N Deo
(74) *Attorney, Agent, or Firm* — Venable LLP

(57) ABSTRACT

A method of manufacturing a liquid ejection head includes forming a resist film on a first surface of a light-transmitting support having the first surface and a second surface being a back surface of the first surface; bonding a back side of the surface of the resist film to the support side on a substrate having a through hole so as to block the through hole; exposing the resist film with light transmitted from the second surface to the first surface of the support and forming a portion which is removable with a dissolving liquid and a portion which remains against the dissolving liquid on the resist film; immersing the substrate and the exposed resist film in the dissolving liquid, allowing the dissolving liquid to enter the through hole, and removing the removable portion; and peeling the support from the resist film from which the removable portion has been removed.

10 Claims, 5 Drawing Sheets

METHOD OF MANUFACTURING LIQUID EJECTION HEAD AND METHOD OF FORMING RESIST

BACKGROUND OF THE INVENTION

Field of the Invention

The present disclosure relates to a method of manufacturing a liquid ejection head which ejects liquid and a method of forming a resist on a substrate.

Description of the Related Art

Various methods are known as methods for manufacturing an ink jet head (also referred to below as a liquid ejection head) in which recording is performed by ejecting ink onto a target recording medium. Japanese Patent Application Laid-Open No. 2015-104876 describes a method of manufacturing a flow path forming member of a liquid ejection head using a dry film.

A brief description will be given of the method of manufacturing a flow path forming member of a liquid ejection head described in Japanese Patent Application Laid-Open No. 2015-104876. A substrate includes an energy generating element, which imparts energy for ejection to a liquid, and a hole (supply path) for supplying ink formed therein. A first dry film supported by a support is transferred onto the substrate so as to block the supply path. Then, after the first dry film is submerged in the supply path, the support is peeled off. Next, an exposure process for forming a flow path pattern is performed on the first dry film. Since the first dry film is a positive resist, the non-exposed regions become the mold material of a flow path and a pressure chamber. Furthermore, after a second dry film supported by the support is transferred to the first dry film, the support is peeled off. Then, an exposure process for forming an ejection orifice is performed on the second dry film. Thereafter, the first and second dry films are immersed in a developer to form a liquid flow path, a pressure chamber, and an ejection orifice. The flow path forming member of the liquid ejection head is manufactured through the above steps.

In recent years, there has been a demand for ink jet recording apparatuses to have higher image quality and higher printing speed by miniaturizing and increasing the density of ejection orifices as well as a demand for higher precision in ejection orifice machining in order to achieve the higher image quality demanded for commercial printed materials and business documents. In the manufacturing method described in Japanese Patent Application Laid-Open No. 2015-104876, after the dry films are transferred, the support which supports the dry films is immediately peeled off. Therefore, since there is no longer a support which supports the dry film, there is a possibility that it may be difficult to precisely form the resist thickness on the substrate.

SUMMARY OF THE INVENTION

A method of manufacturing a liquid ejection head of the present disclosure includes a step of forming a resist film on a first surface of a light-transmitting support having the first surface and a second surface which is a back surface of the first surface, a step of bonding a back side of a surface of the resist film on the support side to a substrate having a through hole so as to block the through hole, a step of exposing the resist film with light transmitted from the second surface to the first surface of the support and forming a portion which is removable with a dissolving liquid and a portion which remains against the dissolving liquid on the resist film, a step of immersing the substrate and the exposed resist film in the dissolving liquid, allowing the dissolving liquid to enter the through hole, and removing the removable portion, and a step of peeling the support from the resist film from which the removable portion has been removed.

A method of forming a resist provided on a substrate of the present disclosure includes a step of forming a light-transmitting dissolving layer, which dissolves in a predetermined solvent, on a first surface of a light-transmitting support having the first surface and a second surface which is a back surface of the first surface; a step of forming a resist film on a back side of a surface of the dissolving layer on the support side; a step of bonding a substrate to a back surface of a surface of the resist film on which the dissolving layer is formed; a step of exposing the resist film with light transmitted from the second surface to the first surface of the support and further transmitted through the dissolving layer and forming a portion which is removable with a dissolving liquid and a portion which remains against the dissolving liquid on the resist film; a step of immersing the substrate, the exposed resist film, and the dissolving layer in the dissolving liquid, dissolving the dissolving layer with the dissolving liquid, and removing the removable portion and the dissolving layer by allowing the dissolving liquid to enter between the support and the resist film; and a step of peeling the support from the resist film from which the removable portion and the dissolving layer have been removed.

Further features of the present disclosure will become apparent from the following description of exemplary embodiments with reference to the attached drawings.

DESCRIPTION OF THE EMBODIMENTS

Figure 1A:
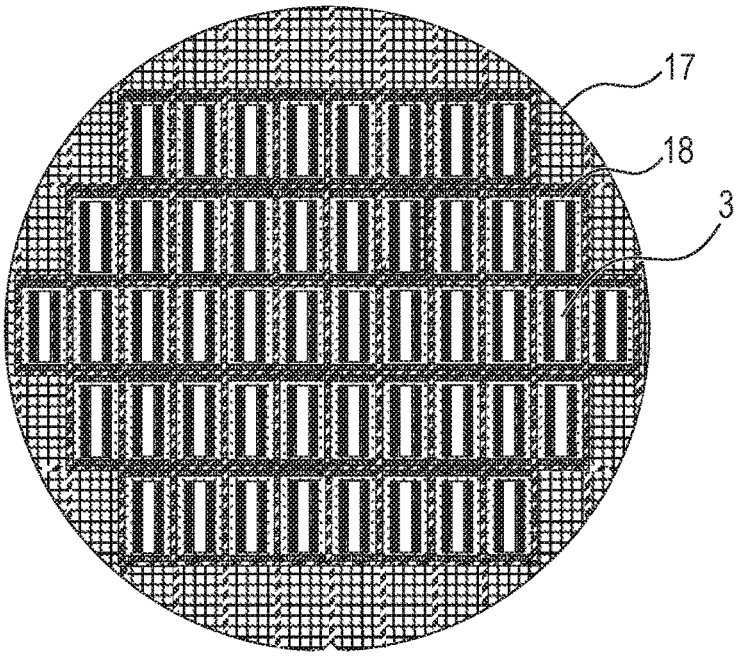
FIGS. 1A and 1B are an upper surface view of liquid ejection heads arranged on a wafer.

A description will be given below of a method of manufacturing a liquid ejection head and a method of forming a resist in embodiments of the present disclosure with reference to the drawings. In each of the embodiments described below, a description will be given of a method of manufacturing a liquid ejection head mounted on an ink jet printer and a method of forming a resist using specific configurations. However, the present disclosure is not limited to these configurations. It is also possible to apply the present disclosure to a method of manufacturing a liquid ejection head used in apparatuses such as a copying machine, a facsimile machine, and a word processor as well as industrial recording apparatuses combining various types of processing apparatuses. It is also possible to apply the present disclosure to a liquid ejection head which ejects a liquid other than ink, for example, a method of manufacturing a liquid ejection head used for applications such as biochip production or electronic circuit printing. Furthermore, it is possible to apply the present disclosure not only to a method of manufacturing a liquid ejection head, but also to a method of forming a resist on a substrate which is not provided with a through hole and a method of forming a resist on a substrate which is provided with a through hole.

In addition, various technically preferable limitations are imposed on the embodiments described below. However, as long as the technical idea of the present disclosure is met, the present disclosure is not limited to the embodiments or other specific methods in the present specification. In the following description, the same numbers are given to configurations having the same function in the drawings and the description of the overlapping portions is omitted.

(Liquid Ejection Head)

Figure 1B:
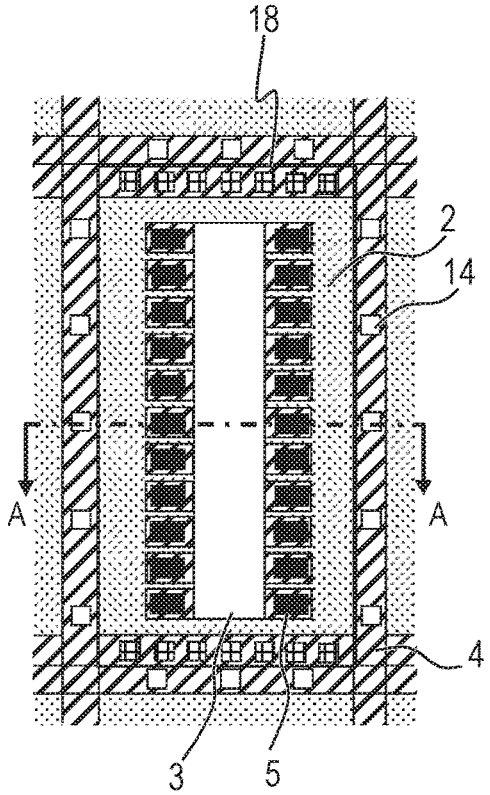

First, a description will be given of liquid ejection heads arranged on a wafer. FIG. 1A is an upper surface view of a wafer on which a plurality of liquid ejection heads are formed. FIG. 1B is a partially enlarged upper surface view showing one liquid ejection head (chip) in the wafer shown in FIG. 1A. Here, strictly speaking, the object formed on the wafer is an element which will later become a liquid ejection head, but this is referred to as a liquid ejection head in the following description for convenience. As shown in FIG. 1A, a plurality of liquid ejection heads 18 are formed on a silicon wafer 17. Each of the liquid ejection heads 18 has a supply path 3 for supplying ink to a flow path 15 and a pressure chamber 12 (refer to FIG. 3F). As shown in FIG. 1B, the supply path 3 is a substantially rectangular through hole formed in the central portion of the substrate 4. The substrate 4 refers to a wafer 17 itself and, when the wafer-like substrate 4 is divided, the individual substrates 4 have shapes corresponding to the individual liquid ejection heads 18. A plurality of energy generating elements 5, which impart energy for ejection to the ink, are arranged in the longitudinal direction of an opening of the supply path 3. The supply path 3 and the energy generating elements 5 are surrounded by a resist film 2 and through holes 14 are formed in the resist film 2. The through holes 14 are provided on the chip cutting line and become a permeation path for the dissolving liquid 9 described below.

Figure 2:
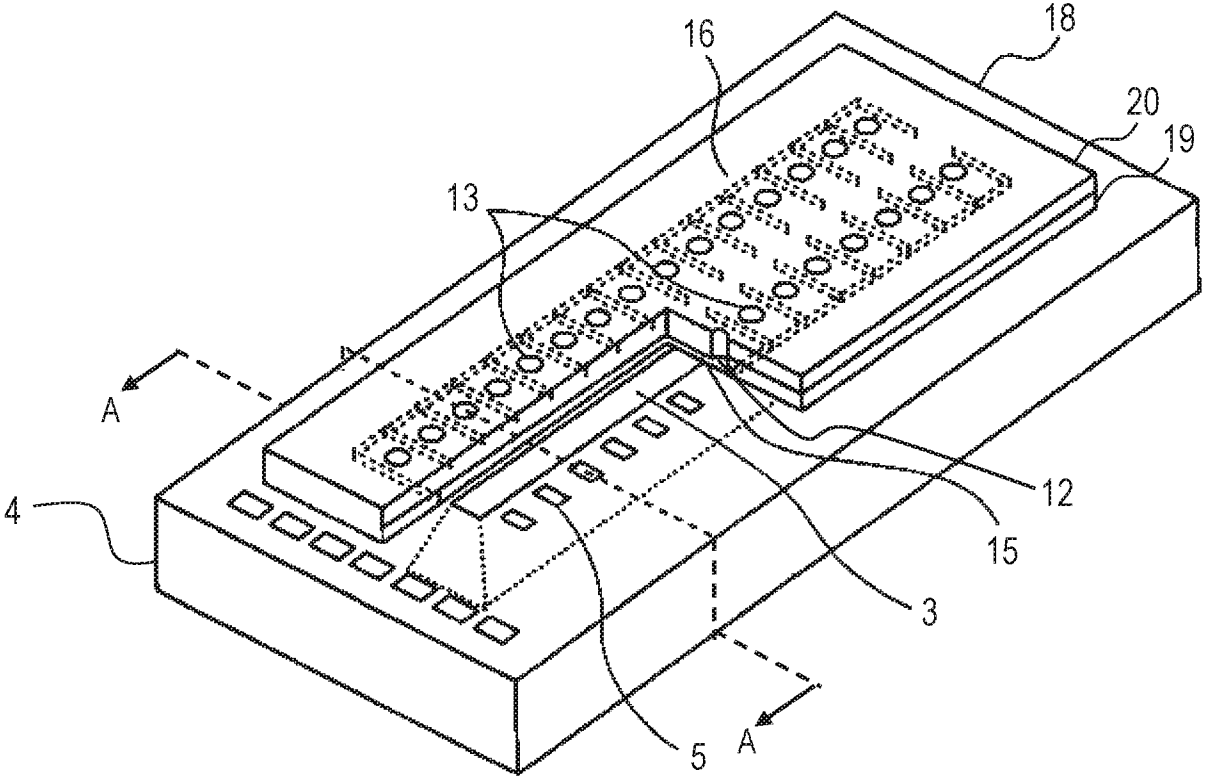
FIG. 2 is a perspective view showing an example of a liquid ejection head.

Next, a description will be given of an example of a liquid ejection head with reference to FIG. 2. FIG. 2 is a schematic perspective view showing a configuration example of a liquid ejection head manufactured through manufacturing steps described below. As shown in FIG. 2, the liquid ejection head 18 has the substrate 4, the energy generating elements 5, the supply path 3, ejection orifices 13, the flow path 15, the pressure chamber 12, and a flow path forming member 16.

The energy generating elements 5 generate energy for ejecting a liquid. As the energy generating elements 5, for example, it is possible to use electrothermal conversion elements or piezoelectric elements. In a case of using an electrothermal conversion element, the element heats a liquid in the vicinity thereof and causes a change in the state of the liquid to generate ejection energy. The flow path forming member 16 forms a flow path 15 and a pressure chamber 12 filled with a liquid between the flow path forming member 16 and the substrate 4. The liquid is supplied from the supply path 3 through the flow path 15 to the pressure chamber 12 and ejected from the ejection orifice 13 by the energy generated by the energy generating elements 5.

The flow path forming member 16 is formed of a side wall portion 19, which forms the flow path 15 and a part of the pressure chamber 12, and a ceiling member 20, which forms the ejection orifices 13, with the side wall portion 19 and the ceiling member 20 being integrally formed. The substrate 4 is formed of, for example, a silicon wafer formed of a single crystal of silicon for which the surface is a (100) surface.

First Embodiment

A description will be given of each step of a liquid ejection head manufacturing method according to a first embodiment with reference to FIGS. 3A to 3H. FIG. 3A and FIGS. 3C to 3H are cross-sectional views along line A-A in FIG. 1B, schematically showing each step of the method of manufacturing a liquid ejection head.

Figure 3A:
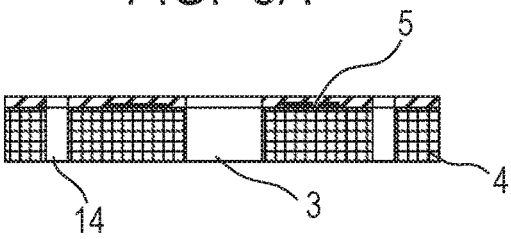
FIGS. 3A, 3B, 3C, 3D, 3E, 3F, 3G and 3H are a step diagram showing an example of a method of manufacturing a liquid ejection head.

First, as shown in FIG. 3A, the supply path 3, which penetrates the substrate 4 in the thickness direction, is formed in the silicon substrate 4 on which the energy generating elements 5 and a drive circuit thereof (not shown) are formed (step 1). It is possible to form the supply path 3 by etching. Specifically, a mask resist having an opening pattern for the supply path 3 is formed on the substrate 4 on which the energy generating elements 5 are formed. Then, wet etching is performed using a chemical reaction with a solution such as tetramethylammonium hydroxide (TMAH) or potassium hydroxide (KOH). In an example, the supply path 3 is formed in the substrate 4 by immersing the substrate 4 for 20 hours in an aqueous solution (etching solution) obtained by diluting TMAH to 22% and adjusted to a temperature of 83° C. Other etching methods include dry etching such as reactive ion etching (RIE). Furthermore, examples of a method of forming the supply path 3 include blasting methods such as laser ablation and sand blasting.

In a case where electrothermal conversion elements are used as the energy generating elements 5, a removable protective film may be attached thereto in order to prevent the energy generating elements 5 from being damaged when the supply path 3 is formed on the substrate 4. One example of a protective film is a passivation film.

Figure 3B:
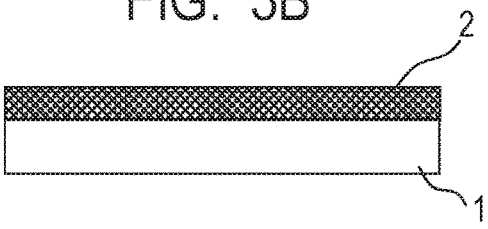

Next, as shown in FIG. 3B, the resist film 2 is formed on the support 1 (step 2). The resist film 2 is a member which becomes the side wall portion 19 of the flow path forming member 16. The type of the resist film 2 is not limited as long as the resist film 2 has photosensitivity, but a negative resist is used in the present embodiment. It is also possible to use a positive resist as the resist film 2. The resist film 2 is preferably a resin having a softening point of approximately 40 to 120° C. and which dissolves in an organic solvent, for example, an epoxy resin, an acrylic resin, a urethane resin, or the like. Examples of the epoxy resin include a bisphenol A type resin, a cresol novolak type resin, a cyclic epoxy resin, and the like. Examples of the acrylic resin include polymethyl methacrylate and the like. Examples of the urethane resin include polyurethane and the like. It is possible to form the resist film 2 using a spin coating method, a slit coating method, or the like. The spin coating method is a method of forming a thin film using centrifugal force by rotating a table on which a wafer is placed at a high speed. The slit coating method is a method in which a thin film is directly coated on a portion on the wafer where the thin film is to be formed. The resist film 2 is preferably formed with a thickness of 3 to 20 μm. In order to form the resist film 2 with this thickness, the viscosity of the solvent (solution) for dissolving the resist film 2 is preferably 5 to 150 CP (centipoise) ($50\times10^{-3}$ to $150\times10^{-3}$ Pa·s (Pascal seconds)). As the solvent of the resist film 2, for example, it is possible to use one or more solvents selected from a group formed of PGMEA, cyclohexanone, methyl ethyl ketone, and xylene.

As will be described below, since the resist film 2 on the substrate 4 is exposed (patterned) through the support 1, as the support 1, it is preferable to use a glass substrate, a silicon substrate, or the like having high light transmittance. In addition, in order to precisely transfer the resist film 2 onto the substrate 4, the support 1 is preferably formed of a material having low flexibility. For example, the support 1 preferably has a bending rigidity greater than the substrate 4 on which the resist film 2 is transferred. Since the bending rigidity depends on the thickness of the member, it is preferable to appropriately set the thickness of the support 1 according to the thickness of the substrate 4. In addition, the support 1 may be subjected to a release treatment in order to easily peel the support 1 from the resist film 2 in a subsequent step. It is possible to perform the release treatment, for example, by coating a thin film on the support 1. As the thin film, it is possible to use a resin same as the solvent in which the resist film 2 is dissolved, silicon having high water repellency or a fluorine compound, or the like. In an example, the resist film 2 is coated with a thickness of 11 μm by a spin coating method on the support 1 formed of a glass substrate having a thickness of 1 mm and dried in an oven at 90° C. As the resist film 2, a film obtained by dissolving an epoxy resin and a photoinitiator in a solvent (PGMEA) is used. The photoinitiator is for initiating photopolymerization when forming a pattern using photolithography in step 4 described below and has sensitivity at a light wavelength of 365 nm.

Figure 3C:
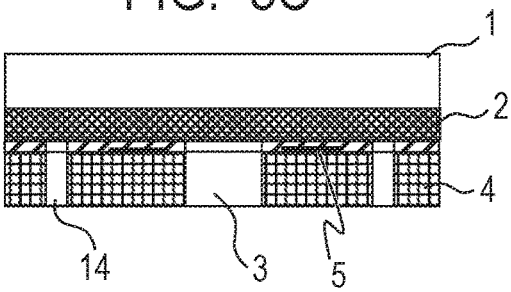

Next, as shown in FIG. 3C, the resist film 2 formed on the support 1 is turned upside down and the back side of the surface of the resist film 2 on the support side is placed on the surface on which the energy generating element 5 of the substrate 4 is formed (step 3). The supply path 3 of the substrate 4, which is a through hole, is blocked by the resist film 2. Next, pressure is applied to the resist film 2 under a condition of a temperature exceeding the softening point of the resist film 2. The resist film 2 is deformed by pressure and bonded to the substrate 4. Examples of a method of bonding the resist film 2 to the substrate 4 include a pressing method and the like. In an example, the resist film 2 held on the support 1 produced in step 2 is bonded to the substrate 4 on which the supply path 3 is formed using a vacuum press. At that time, in order to ensure the precision of the thickness of the resist film 2 formed on the substrate 4, the temperature and pressure are adjusted in accordance with the softening point of the material of the resist film 2. In an example, the resist film 2 is bonded to the substrate 4 under the conditions of a temperature of 120° C., a pressure of 0.4 MPa, and a pressing time of 60 sec such that the thickness of the resist film 2 is 10 μm.

Figure 3D:
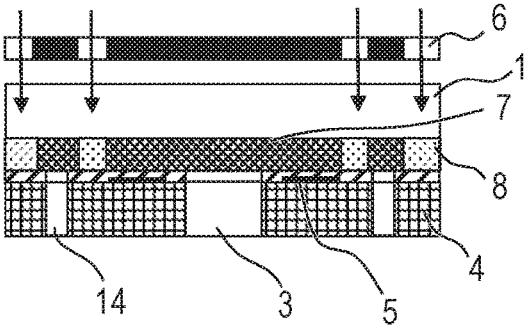

Next, as shown in FIG. 3D, an exposure process of irradiating the resist film 2 with light through a mask 6 is performed (step 4). In the resist film 2, a non-exposed portion 7 covered with the mask 6 and an exposed portion 8 irradiated with light are formed. As described in the next step, by immersion in the dissolving liquid 9, the non-exposed portion 7 becomes a portion to be removed and the exposed portion 8 becomes a remaining portion. As will be described below, the flow path 15 and the pressure chamber 12 are formed from the non-exposed portion 7 and the side wall portion 19 of the flow path forming member 16 is formed from the exposed portion 8. In an example, pattern exposure was performed using an exposure device with light having an exposure wavelength of 365 nm at an exposure amount of 5000 J/m$^2$. Thereafter, post exposure baking (PEB: baking after exposure and before development) is performed at 50° C. for 5 minutes.

Figure 3E:
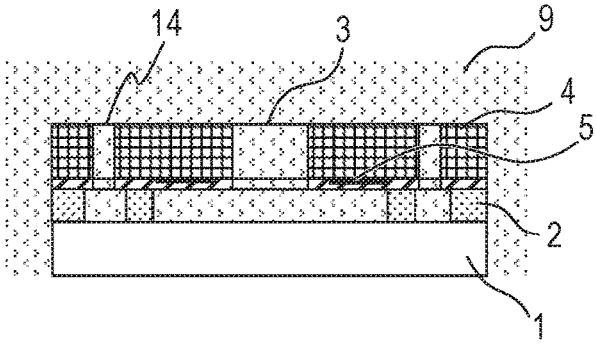
Figure 3F:
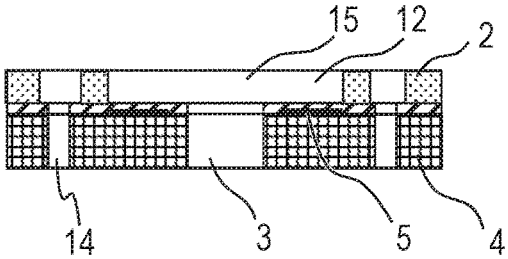

Next, as shown in FIG. 3E, the substrate 4 is turned upside down, the dissolving liquid 9 is supplied from the back surface side of the substrate 4 to the supply path 3 and the through holes 14 of the chip cutting line, and the resist film 2 exposed in the supply path 3 and the through holes 14 is immersed in the dissolving liquid 9 (step 5). In the present embodiment, since the resist film 2 is a negative type, the non-exposed portion 7 is removed and the flow path 15 and the pressure chamber 12 are formed in the resist film 2. In a case where the resist film 2 is a positive type, the exposed portion 8 is removed and the flow path 15 and the pressure chamber 12 are formed in the resist film 2. Specifically, the support 1 is fixed downward with a chuck and the support 1 is immersed in the dissolving liquid 9. The dissolving liquid 9 permeates from the supply path 3 and the through holes 14 of the substrate 4, the non-exposed portion 7 of the resist film 2 is dissolved, and the flow path 15 and the pressure chamber 12 are gradually formed. When the flow path 15 and the pressure chamber 12 are formed, since the contact area between the resist film 2 and the support 1 is reduced, the support 1 is detached from the resist film 2. The smaller the contact area between the resist film 2 and the support 1 is, the lower the force (adhesion force) with which the support 1 holds the resist film 2 is, thus, the peelability of the support 1 from the resist film 2 is improved. The peelability of the support 1 from the resist film 2 depends on the surface energy of the support 1 and the physical properties of the resist film 2. In FIG. 1B, the area of the flow path 15 and the pressure chamber 12 formed by patterning the resist film 2 is preferably 30% or more of the area of the substrate 4. Thereafter, the support 1 is picked up and peeled from the resist film 2, the substrate 4 on which the side wall portion 19 of the flow path forming member 16 is formed is moved to a rinsing tank, and a substrate cleaning process is performed using a rinsing liquid.

As the solvent of the dissolving liquid 9, for example, it is possible to use one or more solvents selected from the group formed of propylene glycol methyl ether acetate (PGMEA), tetrahydrofuran, cyclohexanone, methyl ethyl ketone, and xylene. In an example, PGMEA was used as the dissolving liquid 9, patterning of the resist film 2 was performed using a sheet-fed dip developing device, and the support 1 and the resist film 2 were peeled off. In the cutting line substrate cleaning process, the same PGMEA as the dissolving liquid 9 is used as a rinsing solution.

Figure 3G:
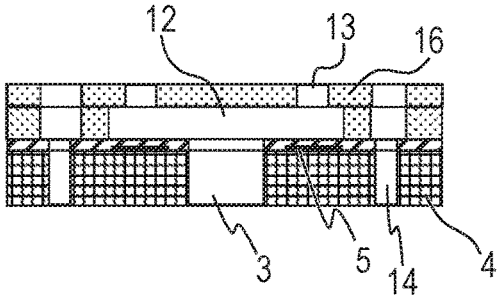

Through step 1 to step 5 described above, as shown in FIG. 3F, the resist film 2 is transferred onto the substrate 4 and it is possible to pattern the resist film 2. Due to this, the side wall portion 19 of the flow path forming member 16 forming the flow path 15 and the pressure chamber 12 is formed on the substrate 4. Next, as shown in FIG. 3G, through steps similar to step 2 to step 5, the ceiling member 20 of the flow path forming member 16, in which the ejection orifices 13 are formed, is formed.

Figure 3H:
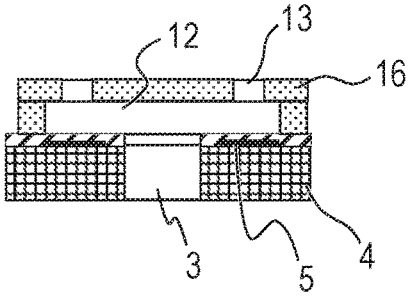

Next, as shown in FIG. 3H, the wafer is cut along dicing lines and it is possible to obtain the liquid ejection head 18 illustrated in FIG. 2. A liquid supply member for supplying liquid to the supply path 3 and an electric wiring member for supplying power and signals for driving to the energy generating element 5 are attached to the liquid ejection head 18 formed through such steps.

Second Embodiment

Next, a description will be given of each step of the resist forming method according to a second embodiment with reference to FIGS. 4A to 4H. FIGS. 4A to 4H are cross-sectional views schematically showing each step of the resist forming method of the present embodiment. Here, description of steps common to the first embodiment may be omitted or simplified.

Figure 4A:
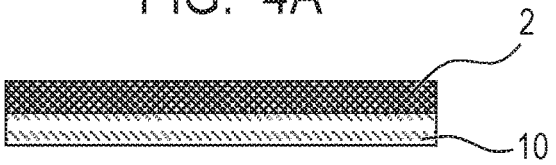
FIGS. 4A, 4B, 4C, 4D, 4E, 4F, 4G and 4H are a step diagram showing an example of a method of forming a resist.

First, as shown in FIG. 4A, the resist film 2 is formed on a film 10 (step 1). As described above, the resist film 2 is a member which becomes the side wall portion 19 of the flow path forming member 16 and is able to be formed by the same method as in the first embodiment. The film 10 is preferably a flexible material so as to be easily peeled from the resist film 2 in a subsequent step. Examples of the material of the film 10 include polyethylene terephthalate (PET), polyimide, olefin, and the like. In addition, the thickness of the film 10 is preferably a thickness with which bending is easy in consideration of peeling. In an example, the resist film 2 is formed by a slit coating method on a 50 μm thick PET film.

Figure 4E:
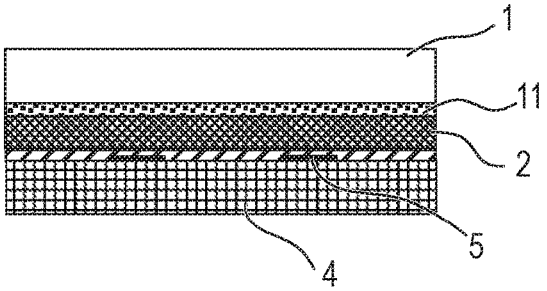
Figure 4B:
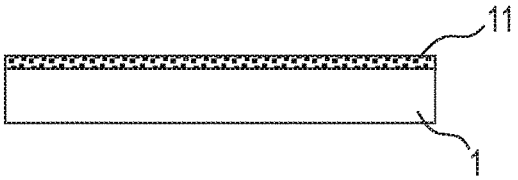

Next, as shown in FIG. 4B, a layer (referred to below as a dissolving layer 11) which is able to be dissolved in a predetermined solvent is formed on the support 1 (step 2). The support 1 may be the same as the support 1 of the first embodiment. The dissolving layer 11 is selected from materials which dissolve in the dissolving liquid 9 in the development step of the resist film 2. For example, the same resin material as that of the resist film 2 is preferably used as the material of the dissolving layer 11. In addition, since light is irradiated through the dissolving layer 11 in the exposure step, the dissolving layer 11 is selected from materials having high light-transmittance. In an example, a material in which a bisphenol A type epoxy resin is dissolved in a PGMEA solvent is used for the dissolving layer 11 and is coated on the support 1 having high light transmittance by a spin coating method.

Figure 4F:
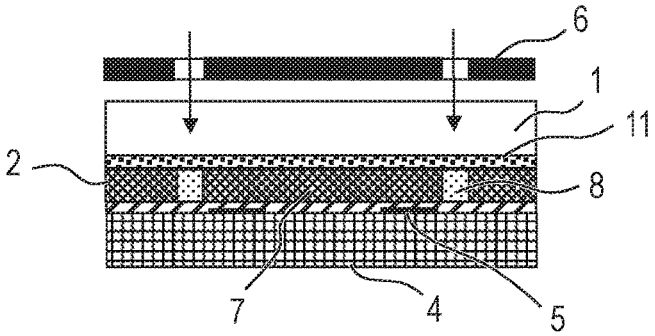
Figure 4C:
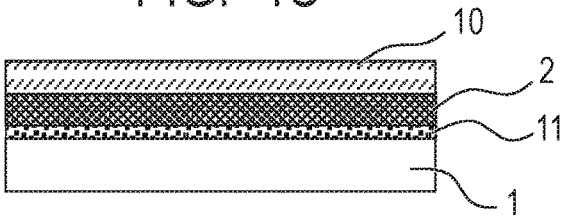

Next, as shown in FIG. 4C, the resist film 2 formed on the film 10 is turned upside down and placed on the surface of the support 1 on which the dissolving layer 11 is formed (step 3). Next, pressure is applied to the resist film 2. The resist film 2 is deformed by pressure and bonded to the dissolving layer 11. Examples of a method of bonding the resist film 2 to the dissolving layer 11 include a pressing method and a laminating method. In order to prevent the dissolving layer 11 and the resist film 2 from melting and mixing together, in an example, the bonding between the support 1 and the film 10 is performed under the conditions of a temperature of 40° C., a pressure of 0.4 MPa, and a pressing time of 60 sec.

Figure 4G:
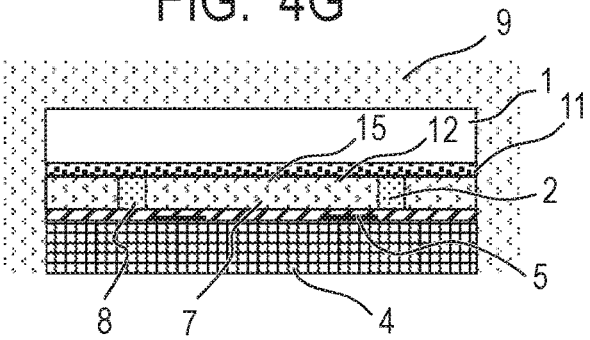
Figure 4D:
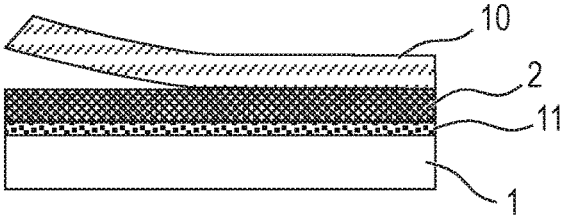

Next, as shown in FIG. 4D, the film 10 is peeled from the support 1 (step 4). At this time, the film 10 is peeled while being bent such that the resist film 2 remains on the support 1 side. In an example, a tape is attached to the peeling start portion of the film 10 and folded back and the film 10 is peeled while being bent. Further, a release film may be coated on the film 10 in order to facilitate the peeling of the film 10 from the support 1. By performing this step, the dissolving layer 11 and the resist film 2 enter a state of being laminated on the support 1.

Next, as shown in FIG. 4E, the support 1 on which the dissolving layer 11 and the resist film 2 are laminated is turned upside down and the surface of the substrate 4 on which the energy generating elements 5 are formed and the back side of the surface of the resist film 2 on the support 1 side are opposed. Then, the resist film 2 is placed on the surface of the substrate 4 on which the energy generating elements 5 are formed (step 5). Next, pressure is applied to the resist film 2. The resist film 2 is deformed by pressure and bonded to the substrate 4. Examples of a method of bonding the resist film 2 to the substrate 4 include a vacuum press method and the like. In an example, the resist film 2 and the substrate 4 are bonded under the conditions of a temperature of 120° C., a pressure of 0.4 MPa, and a pressing time of 60 seconds.

Next, as shown in FIG. 4F, an exposure process of irradiating the resist film 2 with light through the mask 6 from the back side surface of the surface of the support 1 on which the resist film 2 is formed (step 6) is performed. In the resist film 2, the non-exposed portion 7 covered with the mask 6 and the exposed portion 8 irradiated with light are formed. The exposure amount is preferably set in consideration of the transmittance of the dissolving layer 11.

Figure 4H:
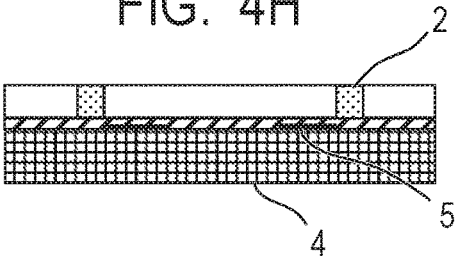
Figure 5:
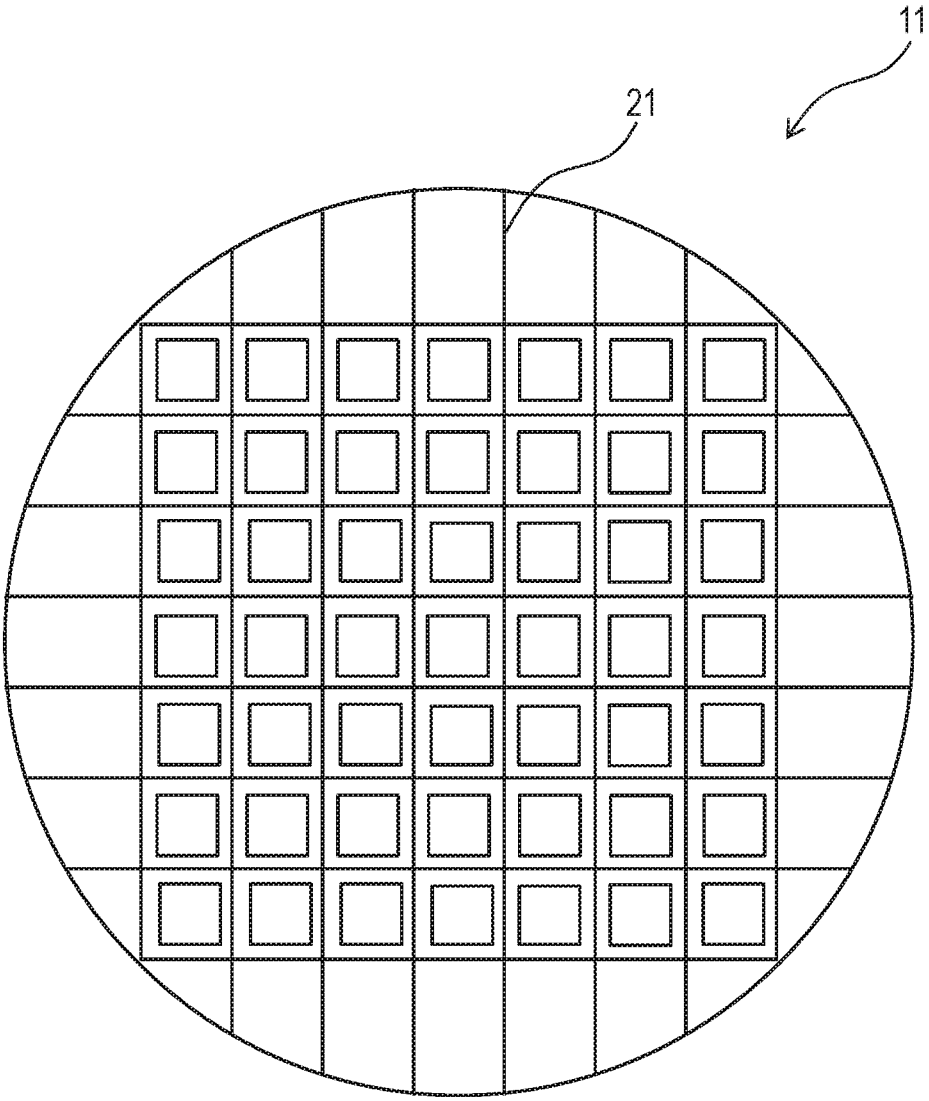
FIG. 5 is a conceptual diagram showing positions of grooves provided along dicing lines in a dissolving layer.

Next, as shown in FIG. 4G, the resist film 2 is immersed in the dissolving liquid 9 and the dissolving liquid 9 is made to immerse the resist film 2. The dissolving liquid 9 enters from the left and right directions of the dissolving layer 11 in FIG. 4G. Due to this, the dissolving layer 11 formed between the support 1 and the resist film 2 and the non-exposed portion 7 of the resist film 2 are removed and the flow path 15 and the pressure chamber 12 are formed in the resist film 2. When the flow path 15 and the pressure chamber 12 are formed, the contact area between the resist film 2 and the support 1 is reduced, thus, the support 1 is detached from the resist film 2. In order to make it easy to detach the support 1 from the resist film 2, it is preferable to provide a groove. For example, a groove 21 is provided in advance in the dissolving layer 11 along a dicing line formed for cutting the wafer and the dissolving liquid 9 is distributed along the groove 21 over the entire dissolving layer 11. FIG. 5 conceptually shows the position of the groove 21. That is, when the surface of the dissolving layer 11 in contact with the support 1 is viewed from the upper surface, the grooves 21 are formed in a lattice shape in the dissolving layer 11, the dissolving liquid 9 permeates in the central direction of the dissolving layer 11 from the cross-section of the grooves of the left and right end portions of the dissolving layer 11. Even in a case where the cross-section of the grooves 21 is not formed at the left and right end portions of the dissolving layer 11, in a case where the end surface of the wafer is exposed at the left and right end portions of the dissolving layer 11, the dissolving liquid 9 enters from the exposed portions. In this manner, the support 1 is peeled by the dissolution of the dissolving layer 11 and the non-exposed portion 7. Next, as shown in FIG. 4H, it is possible to form the patterned resist film 2 on the substrate 4. Furthermore, although omitted from the diagrams, it is possible to obtain the liquid ejection head 18 illustrated in FIG. 2 by later forming the supply path 3 in the substrate 4 and cutting the wafer along the dicing lines.

In the present embodiment, in comparison with the first embodiment, it is possible to form the resist film 2 on the substrate 4 without forming the supply path 3 on the substrate 4. It is not necessary to provide the through holes 14 in the resist film 2. That is, the dissolving layer 11 and the non-exposed portion 7 are removed by being immersed in the dissolving liquid 9 from the left and right end portions of the dissolving layer 11. In the present embodiment, since the supply path 3 is formed in the substrate 4 after forming the side wall portion 19 of the flow path forming member 16, the resist film 2 is suppressed from entering the supply path 3.

As described above, in each embodiment of the present disclosure, the support 1 is peeled in the step of dissolving the resist film 2. Accordingly, the time during which the support 1 supports the resist film 2 is long and it is possible to precisely form the thickness of the resist film 2 on the substrate 4. Further, even in a case where a highly rigid support 1 such as a glass substrate is used, it is possible to easily peel the support 1. In addition, using the support 1 having high rigidity makes it possible to suppress the entry of the resist film 2 into the supply path 3 and to process the supply path 3 with high precision. Furthermore, forming the flow path forming member 16 using a similar step makes it possible to process the ejection orifice 13 with high precision.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-207236, filed Nov. 2, 2018, which is hereby incorporated by reference herein in its entirety.

What is claimed is:

1. A method of manufacturing a liquid ejection head, the method comprising:

a step of forming a resist film on a first surface of a light-transmitting support having the first surface and a second surface which is a back surface of the first surface;

a step of bonding a back side of a surface of the resist film on the support side to a substrate having a through hole so as to block the through hole;

a step of exposing the resist film with light transmitted from the second surface to the first surface of the support and forming a portion which is removable with a dissolving liquid and a portion which remains against the dissolving liquid on the resist film;

a step of immersing the substrate and the exposed resist film in the dissolving liquid, allowing the dissolving liquid to enter the through hole, and removing the removable portion; and a step of peeling the support from the resist film from which the removable portion has been removed.

2. The method of manufacturing a liquid ejection head according to claim 1, wherein the support has higher rigidity than the substrate.

3. The method of manufacturing a liquid ejection head according to claim 1, wherein a flow path and a pressure chamber to be filled with a liquid supplied from the through hole are formed from the removable portion and a flow path forming member forming the flow path is formed from the remaining portion.

4. The method of manufacturing a liquid ejection head according to claim 3, wherein the through hole is a supply path for supplying the liquid to the flow path and the pressure chamber.

5. The method of manufacturing a liquid ejection head according to claim 3, wherein the through hole is provided along a cutting line on the wafer.

6. The method of manufacturing a liquid ejection head according to claim 1, wherein a contact area between the remaining portion and the support is smaller than a contact area between the removable portion and the support.

7. The method of manufacturing a liquid ejection head according to claim 1, wherein a release treatment for peeling the support from the resist film is carried out on the first surface of the support.

8. The method of manufacturing a liquid ejection head according to claim 1, wherein the support is a glass substrate or a silicon substrate.

9. A method of forming a resist comprising:

a step of forming a light-transmitting dissolving layer, which dissolves in a predetermined solvent, on a first surface of a light-transmitting support having the first surface and a second surface which is a back surface of the first surface;

a step of forming a resist film on a back side of a surface of the dissolving layer on the support side;

a step of bonding a substrate to a back surface of a surface of the resist film on which the dissolving layer is formed;

a step of exposing the resist film with light transmitted from the second surface to the first surface of the support and further transmitted through the dissolving layer and forming a portion which is removable with a dissolving liquid and a portion which remains against the dissolving liquid on the resist film;

a step of immersing the substrate, the exposed resist film, and the dissolving layer in the dissolving liquid, dissolving the dissolving layer with the dissolving liquid, and removing the removable portion and the dissolving layer by allowing the dissolving liquid to enter between the support and the resist film; and a step of peeling the support from the resist film from which the removable portion and the dissolving layer have been removed.

10. The method of forming a resist according to claim 9, wherein the dissolving liquid enters along a groove formed in the dissolving layer in advance.

* * * * *